US005433591A

United States Patent [19]

Zingsem et al.

[11] Patent Number: 5,433,591

[45] Date of Patent: Jul. 18, 1995

[54] APPARATUS FOR MAKING A SYNTHETIC FILAMENT YARN

[75] Inventors: Martin Zingsem, Remscheid; Detlev Schulz, Wermelskirchen, both of Germany

[73] Assignee: Barmag AG, Remscheid, Germany

[21] Appl. No.: 30,289

[22] PCT Filed: Jul. 21, 1992

[86] PCT No.: PCT/DE92/00590

§ 371 Date: May 19, 1993

§ 102(e) Date: May 19, 1993

[87] PCT Pub. No.: WO93/02233

PCT Pub. Date: Feb. 4, 1993

[30] Foreign Application Priority Data

Jul. 23, 1991 [DE] Germany ..... 41 24 350.1
Jan. 22, 1992 [DE] Germany ..... 42 01 599.5

[51] Int. Cl.[6] ..... B29C 47/88; D01D 5/092

[52] U.S. Cl. ..... 425/72.2; 264/211.12; 264/211.14; 264/237; 425/404

[58] Field of Search ..... 425/72.2, 404, 464; 264/210.3, 211.14, 211.15, 237

[56] References Cited

U.S. PATENT DOCUMENTS

| | | | |
|---|---|---|---|
| 3,129,272 | 4/1964 | Ferrier et al. | 264/211.14 |
| 3,492,691 | 3/1970 | Carr | 264/211.14 |
| 3,497,586 | 2/1970 | Hemker et al. | 264/211.14 |
| 3,672,801 | 6/1972 | Caldwell et al. | 425/71 |
| 4,134,882 | 1/1979 | Frankfort et al. | 528/308.2 |
| 4,332,764 | 6/1982 | Brayford et al. | 264/210.3 |
| 4,687,610 | 8/1987 | Vassilatos | 264/211.14 |
| 4,863,662 | 9/1989 | Hasegawa et al. | 264/211.14 |
| 4,943,220 | 7/1990 | Fourne | 425/72.2 |

FOREIGN PATENT DOCUMENTS

| | | | |
|---|---|---|---|
| 747592 | 2/1944 | Germany . | |
| 1914556 | 3/1970 | Germany . | |
| 3406347 | 10/1984 | Germany . | |
| 59-168112 | 9/1984 | Japan . | |
| 468482 | 3/1969 | Switzerland . | |
| 461175 | 2/1975 | U.S.S.R. | 425/72.2 |
| 492600 | 11/1975 | U.S.S.R. | 425/72.2 |

*Primary Examiner*—Jay H. Woo
*Assistant Examiner*—Joseph Leyson
*Attorney, Agent, or Firm*—Bell, Seltzer, Park & Gibson

[57] ABSTRACT

An apparatus for producing a synthetic filament yarn including a spinneret and cooling shaft. A plurality of air deflecting members in the form of coaxial tubes or flat plates are mounted within the cooling shaft so that the upper edge of each tube or plate lies closely adjacent the periphery of the bundle of extruded filaments, and the lower edge of each tube or plate is at a distance from the filaments greater than that of the upper edge. The deflecting members thus serve to shield the filaments from air turbulence and also to remove from the filaments a significant portion of the heated air which is entrained with the advancing filaments.

14 Claims, 4 Drawing Sheets

APPARATUS FOR MAKING A SYNTHETIC FILAMENT YARN

BACKGROUND OF THE INVENTION

The invention relates to an apparatus for making a synthetic filament yarn from filaments which are extruded through a spinneret, then quenched with air in a cooling shaft, and then gathered to form a continuous filament yarn.

In the above process, the filaments exit from the spinneret in a liquid condition, and it is common practice to cool the filaments as they exit from the spinneret so as to solidify the thermoplastic material, of which they consist, to then combine, and finally wind same to form a package. If desired, the filaments are treated, while they are combined to a yarn, in a suitable yarn lubricating device for purposes of a textile quality improvement.

For purposes of cooling, the filaments advance directly below the spinneret through a tube or shaft, with currents of cooling air being directed transversely to the bundle of filaments. These currents of cooling air can be produced by applying positive air pressure at the outside of the tube or shaft. However, it is also possible, especially at high filament speeds, to provide a porous tube or shaft with ambient air at atmospheric pressure surrounding the tube or shaft. In this case, the high filament speeds will generate a vacuum within the tube or shaft so that atmospheric air is sucked in and directed as a current of cooling air transversely of the bundle of filaments.

In this manner, it is possible to obtain on the one hand and as an example for filaments with an extremely fine denier, also known as microfibers, which connote spun filament yarns, filaments having a diameter of about 6–12 micrometers after the spin draw process. However, the extremely fine filaments of microfilament yarns are particularly susceptible to disturbances, i.e., among other things, their Uster values may be adversely affected by turbulences which may occur in the blown air chamber.

On the other hand, however, also industrial yarns which are composed of filaments having a substantially coarser denier, are obtained in this manner. For their cooling or solidification necessary for the takeup, substantially longer blown air shafts or yarn passageways are required than for filaments having a finer textile denier.

It is therefore the object of the present invention to provide an apparatus for reducing, on the one hand, the disturbing influences on the spun filaments, as by the air turbulences in the blown air cooling shaft which may possibly be generated by the advancing yarn, and on the other hand, to reduce the length otherwise necessary of the distance covered by industrial yarns between the spinneret and the takeup station by means of an improved air cooling in the yarn shaft or passageway.

SUMMARY OF THE INVENTION

The above and other objects and advantages of the present invention are achieved by the provision of an apparatus which comprises a spinneret for extruding a plurality of filaments which advance downwardly in the form a bundle of filaments from the spinneret, a cooling shaft positioned below the spinneret for cooling the bundle of filaments passing therethrough, and at least one air deflecting member which defines an upper edge and a lower edge, with the deflecting member being mounted at a location spaced below the spinneret and so that the upper edge lies transversely to and closely adjacent the periphery of the bundle of filaments, and the lower edge is at a horizontal distance from the periphery of the bundle of filaments greater than that of the upper edge. By this construction, the air deflecting member acts to shield the filaments from air turbulence and to also remove from the filaments a significant portion of the heated air which is entrained with the advancing bundle of filaments.

In one preferred embodiment of the invention, the advancing bundle of filaments is of converging conical configuration, and the apparatus comprises a plurality of air deflecting members which are tubular and are positioned in an axially spaced but overlapping arrangement along the advancing bundle of filaments. This construction provides for improved protection of the filaments from air turbulence, since the tubular members extend lengthwise of the downwardly tapering bundle of filaments, and are capable of progressively receiving and discharging the air exiting from the bundle. In this connection, it should be particularly recognized that the air currents resulting from the displacement of air from the bundle of the filaments develop damaging properties especially in the area ahead of the convergence of the filaments, i.e. at the apex of the cone.

The upper edges of the tubular members may be arcuately curved so as to flare away from the advancing bundle of filaments. This configuration has been found to be effective in protecting the filaments from the turbulences and to deflect the air which is diverted by the tubular members away from the filaments.

The plurality of air deflecting tubular members may each include a radial slot therethrough, with the slots being radially aligned. This construction permits the yarns or filaments to be inserted into the air deflecting members.

The air deflecting members are preferably located adjacent the opening in the bottom wall of the cooling shaft, which serves to protect the filaments or yarn at a location of the cooling shaft which is particularly prone to turbulence. Also, the air deflecting tubular members are preferably mounted to the cooling shaft so as to permit relative axial movement between the members and the cooling shaft. This permits the air deflecting members to be easily adapted to accommodate particular operating conditions.

In another embodiment of the invention, the cooling shaft has a rectangular cross sectional configuration and the apparatus comprises a plurality of air deflecting members which are in the form of pairs of plates which are mounted along respective opposite side walls of the cooling shaft. This construction has proven itself in connection with course denier industrial yarns as a means for reducing the length of the yarn cooling shaft or the distance covered by the yarn between the spinneret and the take up device in conventional apparatus with a comparable cooling capacity.

BRIEF DESCRIPTION OF THE DRAWINGS

Some of the objects and advantages of the present invention having been stated, others will become apparent as the description proceeds and when considered in conjunction with the accompanying drawings, in which.

DETAILED DESCRIPTION OF THE PREFERRED EMBODIMENTS

Figure 1:
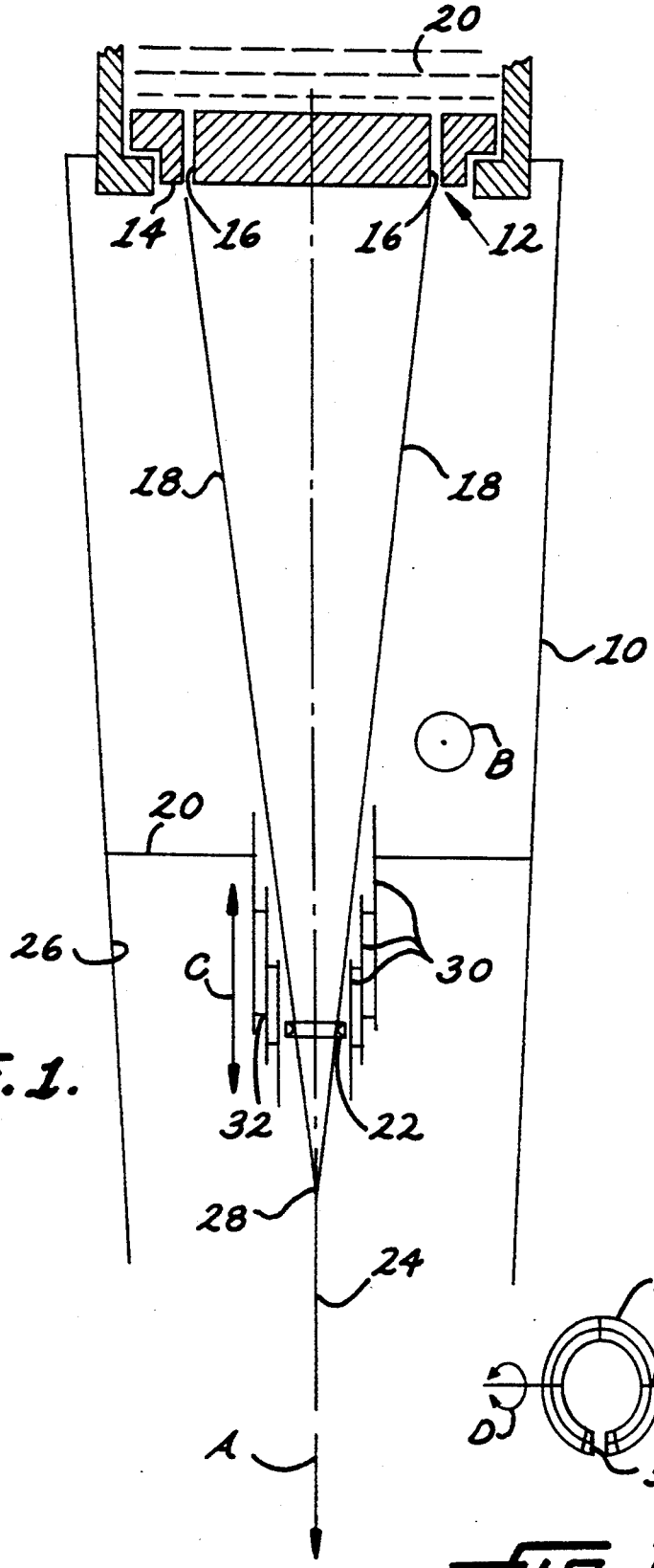
FIGS. 1–3 are each schematic side elevation views of alternate embodiments of an apparatus for producing synthetic filament yarn in accordance with the present invention.
Figure 2:
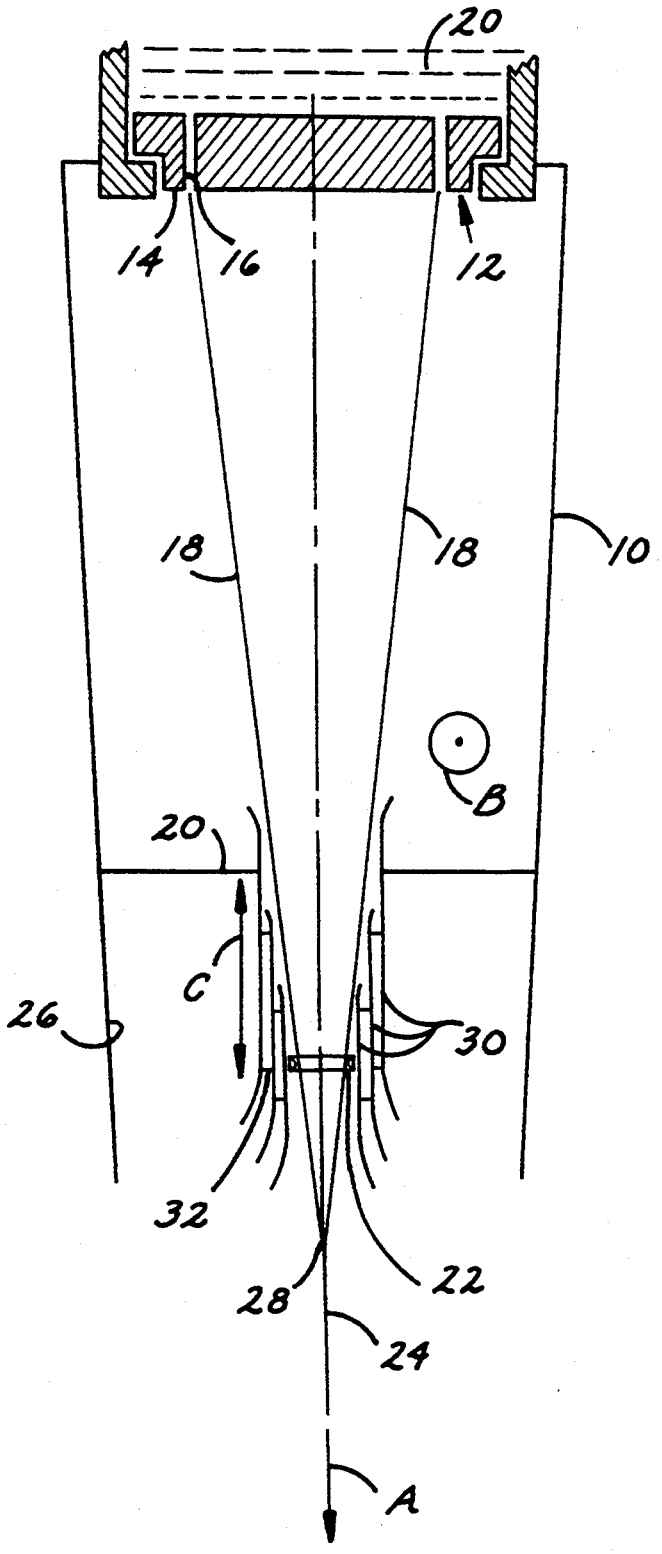
Figure 3:
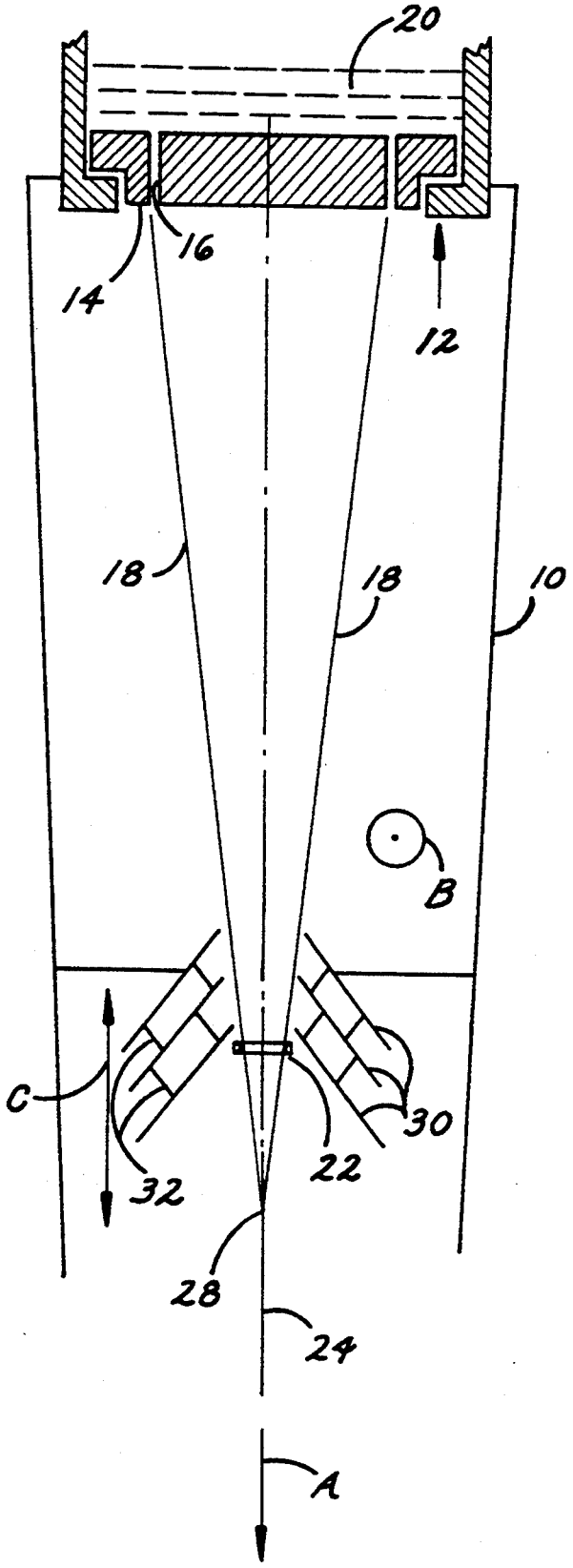

The apparatus for producing filaments 18 as shown in FIGS. 1–3, are substantially of the same construction. More particularly, each apparatus comprises a blown air cooling shaft 10, the upper portion or ceiling of which accommodates a spin pack 12 known per se, the spinneret 14 of which contains nozzle holes 16 commonly used for melt spinning. The number of the nozzle holes 16 may range between 50 and 200. The nozzle holes 16 have an inside width which is dimensioned such that under consideration of the flow rate passing therethrough, the melt and its viscosity form filaments with diameters, i.e., deniers of certain values, approximately 25 to 50 cm downstream of the so-called "spinning bulb" which forms at the outlet opening of the nozzle.

Normally, the filaments consist of a thermoplastic plastic, for example, polyester or polyamide, which is in a molten condition pressed by an extruder not shown, via a filter, through the openings 16. The filaments 18 exiting in a plasticized condition from openings 16 are exposed to a cooling air current in the blown air shaft for purposes of solidifying. The air current may flow, for example, perpendicularly to the direction of withdrawal A shown in the drawing, thus intersecting the filaments substantially perpendicularly. The velocity of the blown air current may range from 0.1 to 0.6 meters per second.

In known manner, the filaments are combined at the filament bundling point 28 to a bundle forming a yarn 24, and guided through an opening coaxially opposite to the spin pack 12 in the bottom 20 of blown air shaft 10. Attached to the opening in bottom 20 is the air deflecting device of the present invention. It consists of several sheet-like elements, for example three small tubes 30 inserted into one another, whose exterior is connected with the bottom 20 of air shaft 10 such that the device can be displaced vertically to the bottom 20 as is indicated by double arrow C. Preferably, the tubes have each an axial length of 60 to 100 mm, and are inserted into one another such that the device has an overall length of approximately 80 to 150 mm when measured from the upper edge of the outer tube to the lower edge of the inner tube. The diameter of the tubes may range from 10 to 30 mm, but can also be larger or smaller, if need arises.

The tubes 30 thus inserted into one another are joined to one another by crosspieces 32 such that they form air gaps between them. As shown in FIG. 1, the tubes 30 are coaxial with respect to one another and offset in axial direction such that their upper edges are each at the same distance from the filaments located externally in the bundle of filaments. The vertical adjustability of the tubes allows to adjust the spacing between the filaments and the upper edges of the tubes in accordance with requirements.

Not only do the tubes 30, in particular the external tube, keep away from the filaments the turbulences which exist in the interior of blown air shaft 10, but also the upper edges of the tubes 30 which are close to the filaments, permit the air entrained and heated by the filaments to be removed therefrom. This air is then allowed to escape through the gaps formed between the tubes into a shaft 26 extending below bottom 20, preferably in a direction directed away from the filaments or respectively the bundle of filaments. This means that in the region of the bottom plate of air shaft 10, where turbulences may be very strong as a result of air circulations, the tubes keep the filaments in a relatively quiet zone.

Figure 1A:
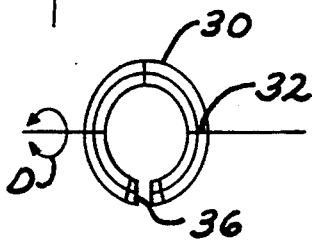
FIG. 1*a* is a cross sectional view of the air deflecting members of the embodiment of FIG. 1.

As is shown in FIG. 1*a*, the tubes 30 are slotted. The slots extend in the same longitudinal sectional plane and form a slot 36 which permits the filaments to be inserted into a passageway defined within the tubes 30.

The inner tube comprises a yarn lubricating device which is formed in the illustrated embodiment by a ring 22 which is likewise slotted, as are the tubes 30, for insertion of the filaments 18. In known manner, the yarn lubricating device serves to apply to the filaments a preparation in the form of a liquid which is supplied via lines not shown, and to combine the individual filaments to a yarn 24. If need be, the ring 22 of the lubricating device may be replaced with preparation sticks of the conventional type or nozzles which cooperate with metering pumps.

The apparatus shown in FIG. 2 differs from that of FIG. 1 by the shape of the tubes. The air deflecting device of FIG. 2 consists of three tubes inserted into one another, whose upper and lower edges flare outwardly in the form of a funnel, thereby contributing to an increasing extent to keeping away the undesired turbulences from the filaments 18, and to deflect the air which is diverted by the tubes from the filaments, radially from the bundle of filaments or respectively the combined yarn 24.

The apparatus shown in FIG. 3 is provided with sheet-like elements 30 one inserted into the other, which have each the shape of the jacket surface of a truncated cone. The upper edge of the sheet-like elements lies closely against the external filaments of the bundle of filaments, and the lower edge is angularly directed away from the bundle of filaments, so that an increased deflection of the air diverted by the sheet-like elements 30 is obtained.

In the same manner as in the embodiment of FIG. 1, the air deflecting devices of FIGS. 2 and 3 are also adapted for movement both in the axial direction of the bundle of filaments and rotatingly thereto, as is indicated by arrows C and D. Otherwise, the cross sectional profile of the tubes corresponds in the described embodiments advantageously to the cross section of the bundle of the filaments exiting from the holes of the spinneret.

The function of the staggered configuration used in the embodiment as an air deflecting device consists in that the air exiting from the bundle is collected and discharged. The exited air is prevented from adversely affecting the bundle of filaments by turbulences and/or from interfering with the air which continues to exit.

Figure 4:
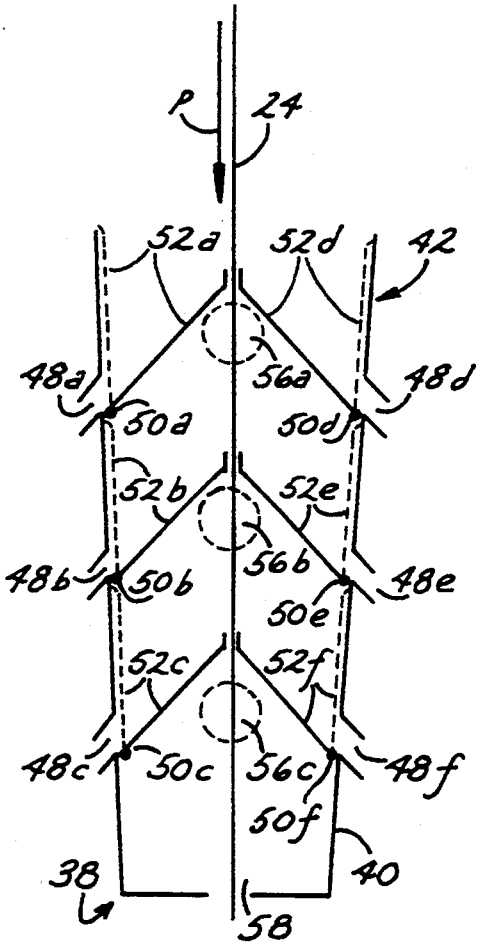
FIG. 4 is a schematic side elevation view of a cooling shaft of a further embodiment of the present invention.
Figure 5:
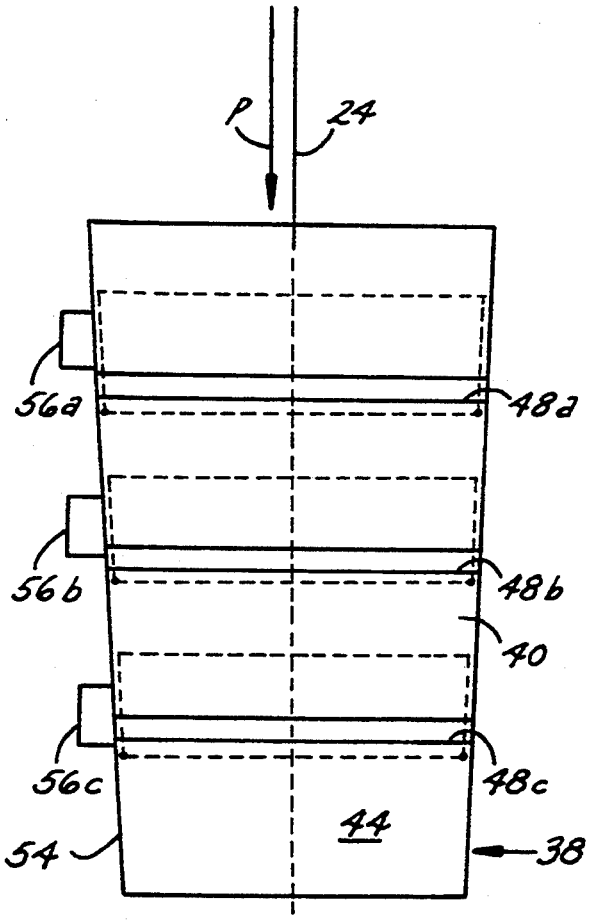
FIG. 5 is a side elevation view of the apparatus shown in FIG. 4.
Figure 6:
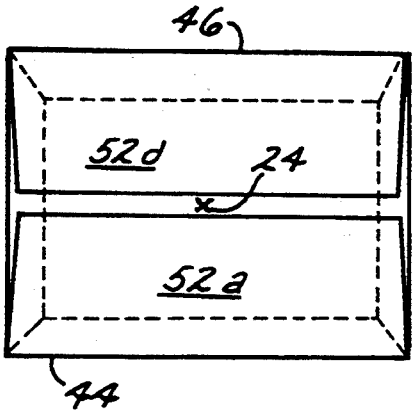
FIG. 6 is a top plan view of the cooling shaft shown in FIGS. 4 and 5.

The apparatus 38 shown in FIGS. 4–6 serves to divert from the spun filaments the hot air which surrounds them. The apparatus 38 consists of a yarn shaft or passageway 40, such as is frequently used, for example in machines for spinning synthetic industrial yarns. The shaft 40 consists of a casing 42 which has a rectangular cross section and narrows toward the bottom. Two opposite walls 44 and 46 are penetrated by parallel extending slots 48*a*–48*f*, whose length corresponds substantially to the width of walls 44 and 46, and which are arranged in the opposite walls 44 and 46 to extend respectively in pairs at the same height in the interior of casing 42.

Located at the lower edge of each slot 48 is a hinge 50*a*–50*f* to which baffles or air deflecting sheet-like elements 52*a*–52*f* are jointed such that they can be pivoted from their operating position shown in solid lines to a position indicated in dashed lines, which makes it possible to guide a yarn 24 unhindered through the shaft 40 from the startup of the machine. The sheet-like elements 52 are preferably bent at their edge removed from the hinge 50 such that the bent smaller portion of the edge is aligned with yarn 24 substantially parallel and close thereto. This portion serves to divert the hot air from the yarn 24 advancing in direction of arrow P, and to cause same to exit from casing 42 through slot 48 arranged at the other edge of sheet-like element 52. Located on an end wall connecting the walls 44, 46 of the shaft 40 are openings 56*a*, 56*b*, 56*c*, each below the sheet-like elements 52, which permit cooling air to enter into shaft 40 to replace the discharged hot air. Preferably, the air inlet holes 56*a*, 56*b*, 56*c* are arranged below the sheet-like elements 52 in their operating positions, and supply to the yarn 24 a comparatively cool air which is diverted by the pair of sheet-like elements 52*b* and 52*e* following next in direction of the yarn advance and discharged through slots 48*b* and 48*e*. In the illustrated embodiment, this procedure repeats itself altogether three times, with the air supplied last through opening 56*c* being discharged with the cooled yarn 24 from the shaft 40 through opening 58 in the bottom thereof. The exchange of the air surrounding the yarn makes it possible to shorten the conventional length of the yarn shaft 40 without reducing its cooling capacity.

As can be noted from the foregoing description, the object of the invention to decrease on the one hand air turbulences which may develop from the advance of the yarn, and to remove on the other hand the hot air surrounding the yarn is accomplished in advantageous manner.

We claim:

1. An apparatus for producing a synthetic filament yarn comprising means including a spinneret for extruding a plurality of filaments which advance downwardly in the form of a converging conical bundle of filaments from the spinneret, a cooling shaft positioned below said spinneret for cooling the bundle of filaments passing therethrough, with said cooling shaft comprising a peripheral side wall and a bottom wall having an opening through which the bundle of filaments advance, a plurality of air deflecting tubular members, each of said tubular members defining an upper edge and a lower edge and being mounted so as to coaxially surround the advancing bundle of filaments adjacent the opening of said bottom wall and so that said upper edge lies transversely to and closely adjacent the periphery of the bundle of filaments and the lower edge is at a horizontal distance from the periphery of the bundle of filaments greater than that of the upper edge, and with said plurality of tubular members being positioned in an axially spaced but overlapping arrangement along the advancing bundle of filaments, whereby each air deflecting member acts to shield the filaments from air turbulence and to also remove from the filaments a significant portion of the heated air which is entrained with the advancing bundle of filaments.

2. The apparatus as defined in claim 1 wherein said upper edges of said plurality of air deflecting tubular members are each located at the same horizontal distance from the periphery of the bundle of filaments.

3. The apparatus as defined in claim 1 wherein said upper edges of said plurality of air deflecting tubular members are each arcuately curved so as to flare away from the advancing bundle of filaments.

4. The apparatus as defined in claim 1 wherein said plurality of air deflecting tubular members are each of essentially cylindrical configuration.

5. The apparatus as defined in claim 1 wherein said plurality of air deflecting tubular members are each of essentially truncated conical configuration.

6. The apparatus as defined in claim 1 wherein said plurality of air deflecting tubular members are interconnected by crosspieces.

7. The apparatus as defined in claim 1 wherein said plurality of air deflecting tubular members each include a radial slot therethrough, with said slots being radially aligned.

8. The apparatus as defined in claim 1 further comprising means mounting said plurality of air deflecting tubular members to said cooling shaft so as to permit relative axial movement between said members and said cooling shaft.

9. The apparatus as defined in claim 1 further comprising yarn lubricating means mounted adjacent said plurality of air deflecting tubular members for applying a lubricant to the advancing bundle of filaments.

10. The apparatus as defined in claim 9 wherein said yarn lubricating means comprises an annular ring positioned to coaxially surround the advancing bundle of filaments.

11. The apparatus as defined in claim 1 further comprising an opening in said peripheral side wall of said cooling shaft for admitting cooling air into the interior thereof.

12. An apparatus for producing a synthetic filament yarn comprising a spinneret for extruding at least one filament which advances downwardly from the spinneret, a cooling shaft positioned below said spinneret for cooling the filament passing therethrough, with said cooling shaft comprising opposite side walls and opposite end walls which are disposed in a rectangular cross sectional configuration, and a bottom wall having an opening therein through which the filament advances, a plurality of air deflecting members mounted in said cooling shaft, each of said air deflecting members comprising a pair of plates which are mounted along respective opposite side walls of said cooling shaft, with each of said pair of plates having an upper edge which lies transversely to and closely adjacent the periphery of the filament, and a lower edge which is at a horizontal distance from the periphery of the filament greater than that of the upper edge, and at least one pair of slots, wherein each par of slots is defined by a slot in each of said side walls located immediately above respective ones of the lower edges of the associated plates of one of said air deflecting members, an opening in at least one of said end walls of said cooling shaft for admitting cooling air into the interior thereof, whereby the air deflecting members each act to shield the filaments from air turbulence and to also remove from the filaments a significant portion of the heated air which is entrained with the advancing bundle of filaments and said at least one air deflecting member acts to direct the removed air outwardly through said slots.

13. The apparatus as defined in claim 12 wherein each of said plates of each of said pairs of aligned plates is pivotally mounted to the associated side wall of said cooling shaft for pivotal movement of the upper edge of each plate away from the filament.

14. The apparatus as defined in claim 13 wherein said cooling shaft includes a plurality of said slots wherein one of said slots is located immediately above the lower edge of each of the associated plates of each of said deflecting members.

* * * * *